United States Patent [19]

Antonczyk et al.

[11] 4,356,650

[45] Nov. 2, 1982

[54] ENCLOSURE AND MOUNTING DEVICE FOR RELIEF ARTWORKS

[75] Inventors: Raymond L. Antonczyk, Chicago, Ill.; Andrew R. Antonczyk, 1030 N. State, Chicago, Ill. 60610

[73] Assignee: Andrew R. Antonczyk, Chicago, Ill.

[21] Appl. No.: 278,059

[22] Filed: Jun. 29, 1981

[51] Int. Cl.[3] ..... G09F 1/10

[52] U.S. Cl. ..... 40/160; 40/10 R; 40/156

[58] Field of Search ..... 40/152, 152.1, 160; 428/13, 14

[56] References Cited

U.S. PATENT DOCUMENTS

| | | | |
|---|---|---|---|
| 1,599,779 | 9/1926 | Michlinsli | 40/160 |
| 2,026,708 | 1/1936 | Rubin | 428/14 |
| 2,521,558 | 9/1950 | Alvarez | 40/152 |
| 2,772,500 | 12/1956 | Cole et al. | 40/160 |
| 3,996,682 | 12/1976 | Schwartz | 40/152 |

FOREIGN PATENT DOCUMENTS

| | | | |
|---|---|---|---|
| 1292521 | 3/1962 | France | 40/152 |

*Primary Examiner*—Paul J. Hirsch
*Assistant Examiner*—Wenceslao J. Contreras
*Attorney, Agent, or Firm*—Louis Altman

[57] ABSTRACT

A frame and protective enclosure is disclosed for artworks, which is particularly suitable for fragile reliefs and other three-dimensional works. The enclosure comprises a transparent shell secured to a backing board. The shell and board are secured and sealed together in a fashion which tends to protect the artwork from atmospheric contaminants. An improved structure is employed for securing the artwork to the backing board in such fashion that it subsequently can be removed without damage, even if the artwork is a paper sculpture or the like.

3 Claims, 8 Drawing Figures

FIG. 1
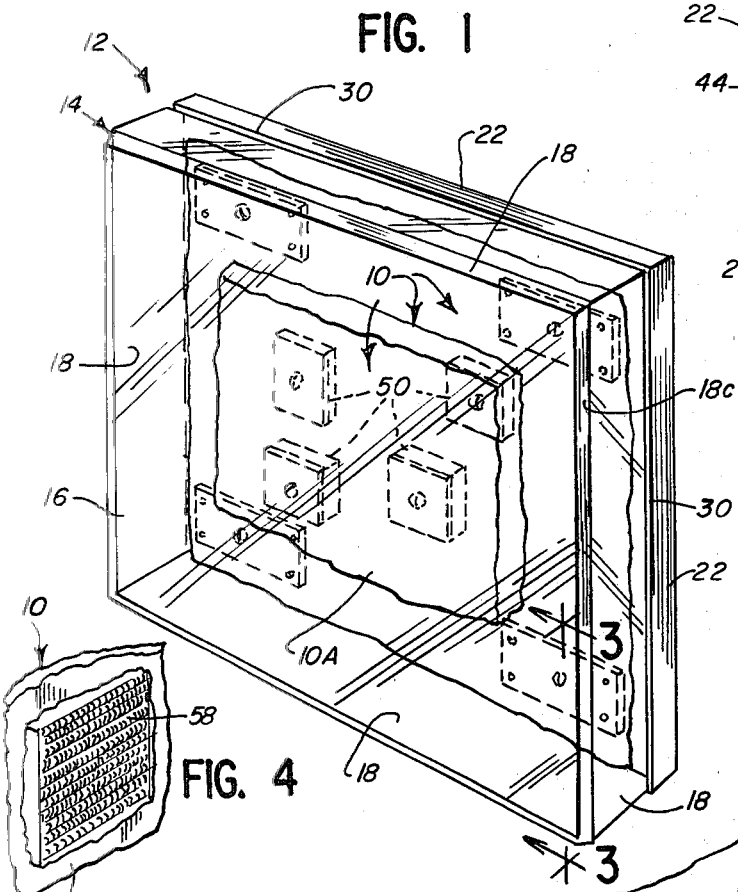
FIG. 2
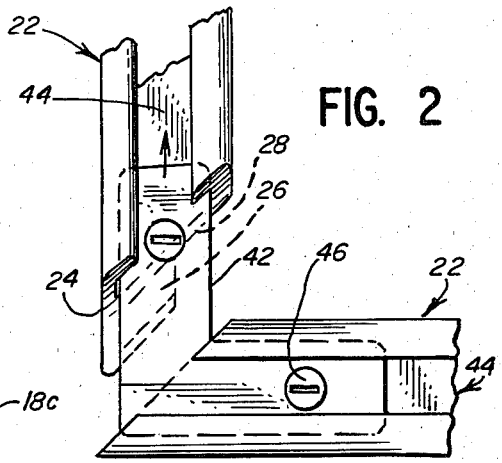
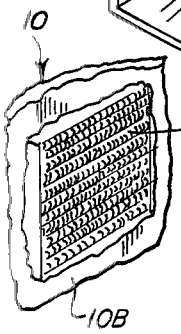
FIG. 4
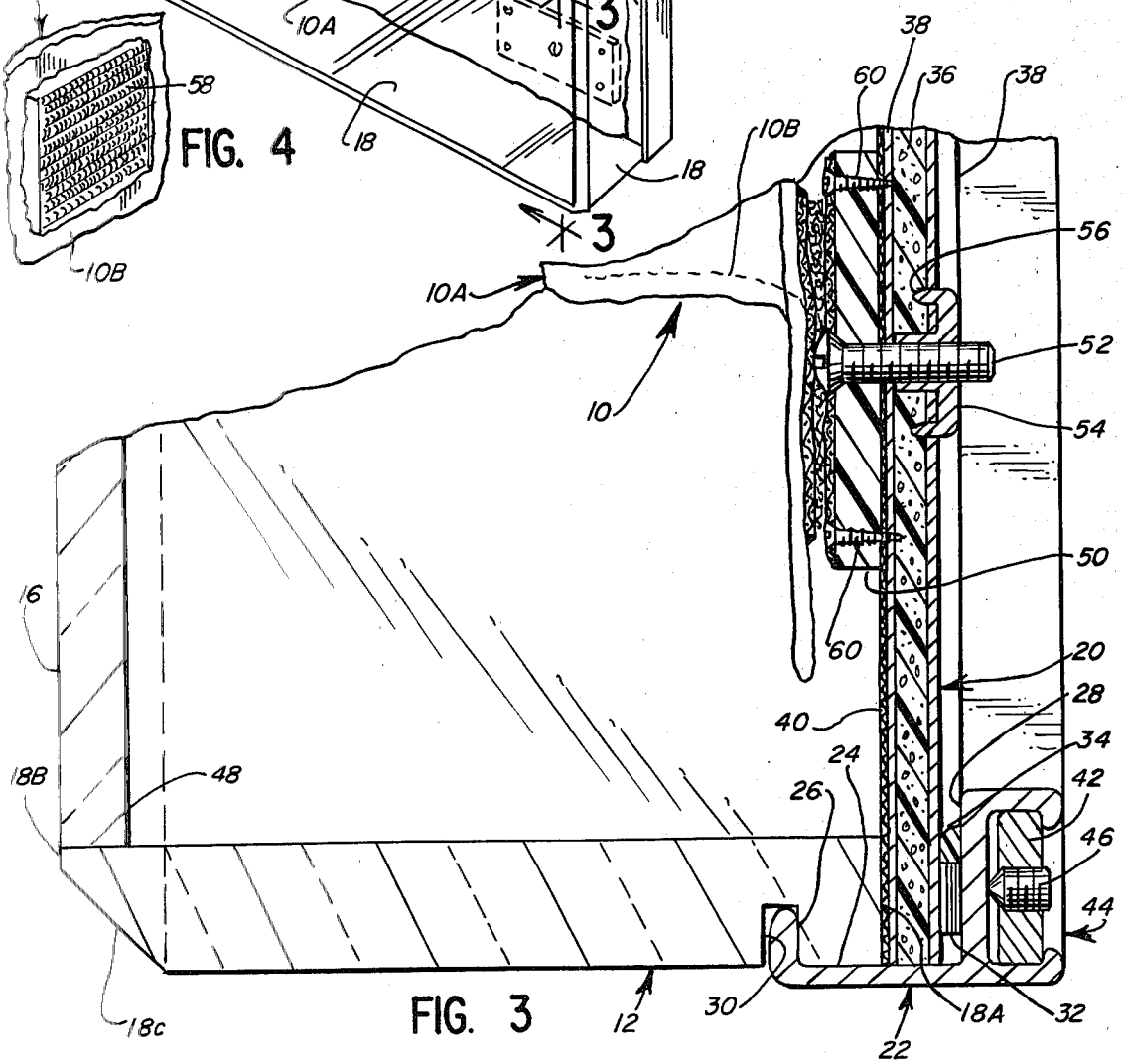
FIG. 3

FIG. 5
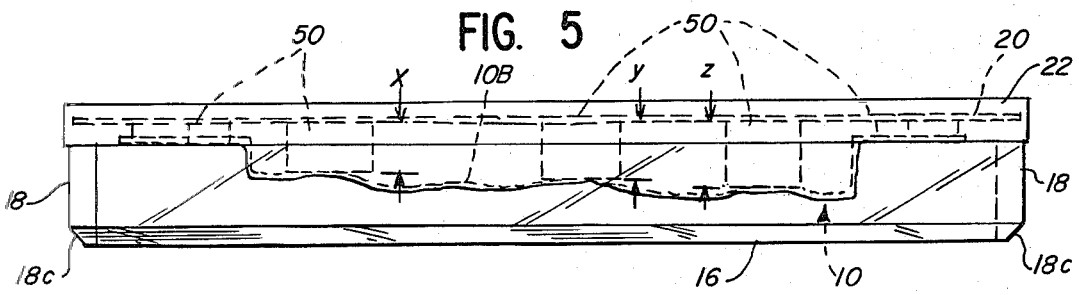
FIG. 6
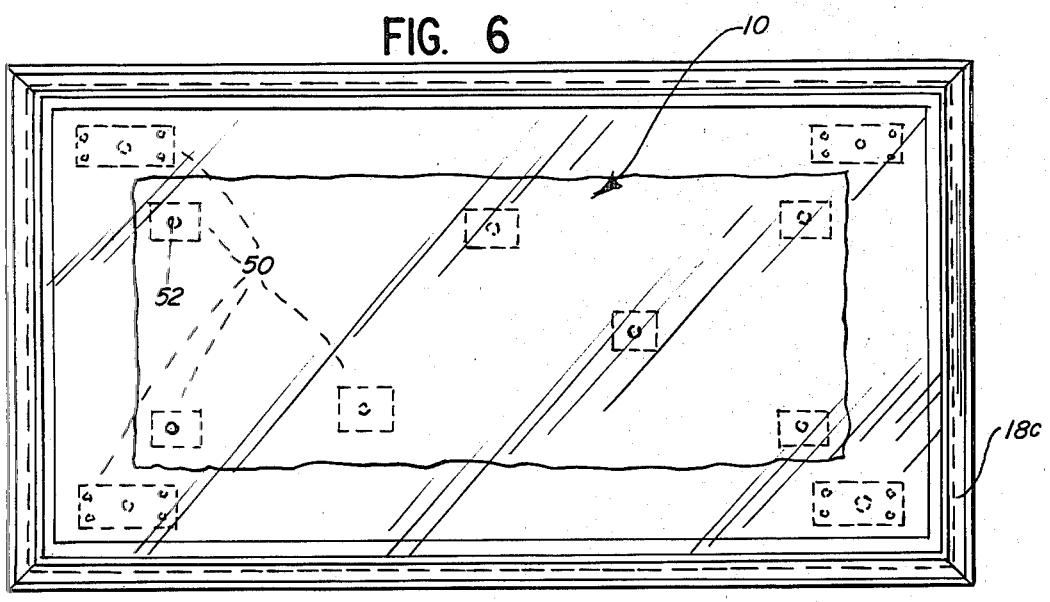
FIG. 7
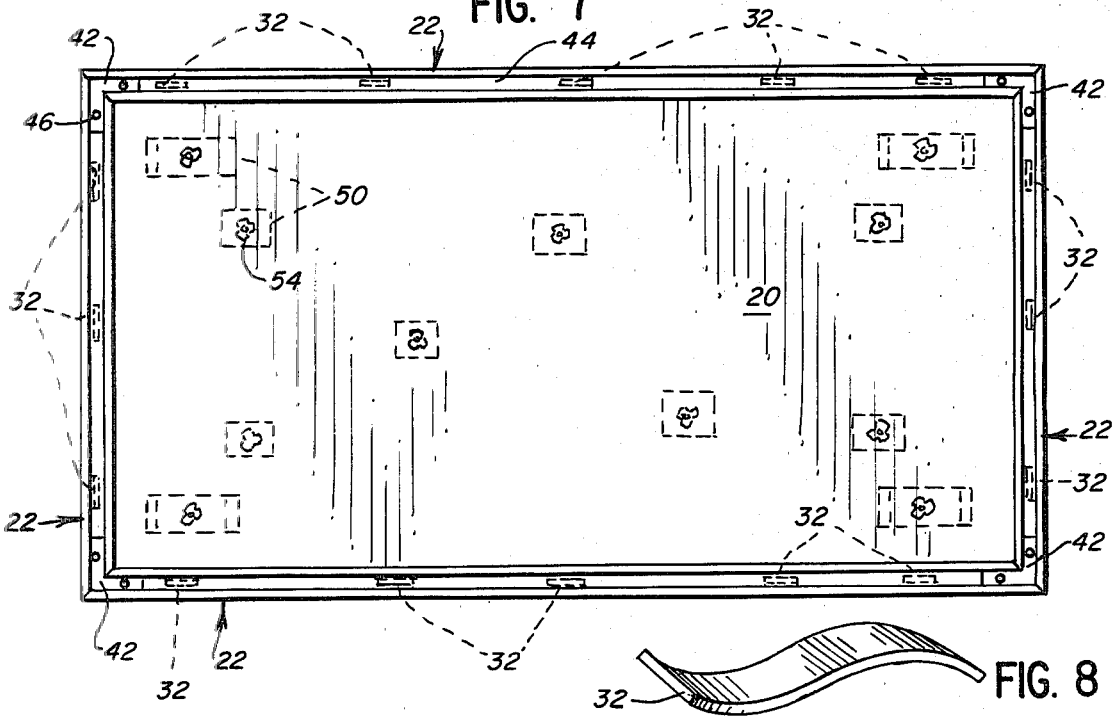
FIG. 8

ENCLOSURE AND MOUNTING DEVICE FOR RELIEF ARTWORKS

This invention relates generally to devices for the framing and mounting of display objects such as artworks in order to protect and simultaneously display them. It particularly concerns a device which encloses a relief or other three-dimensional work of art.

THE INVENTION, ITS BACKGROUND AND THE PRIOR ART

Three-dimensional dislay objects, such as reliefs and other three-dimensional works of art, sometimes need a protective enclosure to prevent damage to the sculptured surface thereof. A conventional frame assembly, which has a transparent glass front plate firmly in contact with the front surface of the artwork, may be satisfactory for most two-dimensional drawings but unacceptable for certain kinds of fragile reliefs which are liable to be crushed or otherwise damaged by contact with the front plate.

One example of such an artwork is a paper sculpture, a relatively new art form in which papier mache or similar material is congealed in the form of a thick sheet having various three-dimensional artistic representations (e.g. human figures) sculptured upon the front surface thereof. If such a work is framed and mounted in the manner appropriate for a flat drawing, the glass front plate will distort, and possibly damage, the three-dimensional features. The same problem can arise with oil paintings employing especially thick paint areas, or other types of art having three-dimensional features.

Such works need a deep enclosure which puts a safe distance between the artwork and the front plate of the enclosure; and they may also need some degree of protection from atmospheric contaminants such as dust, dirt, chemical pollutants, molds, etc. Paper sculptures, being made of organic material, are particularly vulnerable to such ubiquitous hazards. Even two-dimensional works may benefit if protected in this manner.

The invention, accordingly, provides a deep enclosure having a front plate which stands off from the artwork, the enclosure entirely surrounding and to some extent sealing the artwork in a clean atmosphere. The enclosure conveniently may be made-to-measure for each individual paper sculpture, using readily available conventional frame members. Although such frame members are designed especially for use with conventional flat framing techniques, one of the features of this invention permits them to be used in assembling a much deeper enclosure suitable for three-dimensional works as well as for flat drawings.

Then there is the problem of mounting a paper sculpture within such an enclosure. It is undesirable to use screws or other fasteners of the type which penetrate the sculpture, and which might even extend through it and thus be visible upon the front surface thereof. Glueing the back of the paper sculpture directly to a mounting device is also unsatisfactory. A sculpture mounted in that fashion is likely to be damaged if it should become necessary to remove it from its mount. In addition, paper sculptures typically have quite rough and uneven rear surfaces, owing to the nature of the process by which they they are made. As a result, difficulty is encountered in making them adhere to a flat, rigid surface.

The present invention overcomes these problems by using spacers of different thicknesses to accommodate the uneven rear surface of the artwork; and by securing the artwork to the spacers by means of textile fastener pads, e.g. Velcro brand material, since these are flexible and can therefore be easily bonded to a rough, uneven surface. This type of fastener also permits the paper sculpture to be demounted without damage, simply by disengaging two Velcro pads from each other.

The invention thus briefly summarized will now be described in detail in connection with the following drawings:

BRIEF DESCRIPTION OF THE DRAWINGS

FIG. 1 is a perspective view of an artwork in combination with an enclosure and mounting device in accordance with this invention.

FIG. 2 is a rear elevational view of two frame members and an angle bar, partially disassembled, which are employed in the device of FIG. 1.

FIG. 3 is a sectional view, taken on lines 3—3 of FIG. 1.

FIG. 4 is a fragmentary perspective view showing a textile fastener pad secured to the rear surface of the artwork.

FIG. 5 is a top plan view of the artwork and device.

FIG. 6 is a front elevational view thereof.

FIG. 7 is a rear elevational view thereof.

FIG. 8 is a perspective view of a curved leaf spring, several of which are employed in the enclosure and mounting device.

DETAILED DESCRIPTION OF THE PREFERRED EMBODIMENT

FIG. 1 shows a three-dimensional display object in the form of an artwork 10 mounted upon and housed within an enclosure 12 in accordance with the present invention. The artwork 10, for the purposes of illustration, may be considered to be a paper sculpture, that is, an irregular but roughly rectangular pad of *papier mache* or similar congealed cellulosic material having upon its front surface 10A a sculptured relief (not shown) depicting some sort of artistic representation. The enclosure 12 comprises a transparent shell 14 including a front plate 16 and four sidewalls 18. The shell is preferably made of a plastic material such as poly (methyl methacrylate). The enclosure 12 also comprises a backing board 20 (FIG. 3). When the artwork 10 is mounted upon the backing board 20 within the enclosure 12, it is protected from atmospheric contaminants, yet is visible to viewers through the transparent front plate 16.

In addition, as best seem in FIG. 3, the dimensions of the sidewalls 18 are such that the front plate 16 stands off at a generous distance from the backing board 20, thus allowing ample room in the depth of the enclosure 12 for the thickness of the paper sculpture 10 plus additional space between the front surface 10A of the sculpture and the front plate 16. Thus the front plate is not pressed into contact with the sculpture, and therefore does not deform or crush the surface relief features which constitute the artistic content of the sculpture.

This generous depth and the resulting protection of the sculpture from mechanical damage is achieved through the unique features of this invention, even though the enclosure 12 is assembled to the backing board 20 through the use of conventional framing channel members 22, which are specially designed for use with conventional flat framing techniques appropriate for two-dimensional artworks. As best seen in FIGS. 2 and 3, each of these frame members 22 comprises a web 24 formed with a front flange 26 and a rear flange 28. These flanges 26 and 28 confront each other to form a U-shaped channel which is designed to receive a backing board, such as the board 20 employed in the present invention, plus a glass front plate which is closely adjacent to the backing board, with a two-dimensional drawing or painting compressed between the glass front plate and the backing board.

In the present invention, however, the sidewalls 18 of shell 14 are formed with re-entrant grooves 30, best seen in FIG. 3. As revealed in FIG. 1, these grooves extend entirely around the four sides of shell 14. These grooves, which are adapted to receive the front flanges 26, are located much nearer to the rear margins 18A which are the rearmost surfaces of sidewalls 18, than to the front plate 16. Thus, the sidewalls 18 are able to engage the flanges 26 by means of the grooves 30, while at the same time standing off the front plate 16 at a generous distance from the backing board 20 in order to accommodate the depth of the paper sculpture 10.

In order to complete the assembly of the shell 14, backing board 20, and the frame members 22, the invention employs curved leaf springs 32 (see FIGS. 7 and 8) which are inserted, at various locations along the length of the frame members 22, and compressed between the backing board 20 and the rear flanges 28. Thus the leaf springs 32 react against the flanges 28 to keep th backing board 20 pressed tightly against the rear margins 18A of the shell 14.

In addition a caulking material such as silicone putty, which has sealing and adhesive characteristics, is introduced into the space between the backing board 20 and the flanges 28 in the form of a bead 34. This serves the purpose of sealing the interior of the enclosure 12, and also of retaining the leaf springs 32 in place.

The backing board 20 can be made from any number of conventional materials, but the preferred choice is a material which is available from International Paper Company under the brand name Gatorfoam. This material comprises a core 36 in the form of a sheet of plastic foam sandwiched between two wooden facings 38. For use in the present invention, the front facing is preferably covered by a sheet of decorative fabric material 40 which is bonded thereto by means of any suitable adhesive, so as to enhance the appearance of the area surrounding the sculpture 10, which is visible through the transparent shell 14.

As is conventional in the framing art, the four frame members 22 are locked together at the corners of the enclosure 12 by means of right angle bars 42, best seen in FIGS. 2, 3 and 6. The framing members 22 are formed with U-shaped channels 44 at the rear of the flanges 23, and are mitered so as to meet properly at the corners of the enclosure 12. Each arm of the right angle bar 42 at each corner is inserted within the channel 44 of one of the two adjoining frame members 44. Then set screws 46, which are threaded into the respective arms of each angle bar 44, are tightened against the rear of the adjacent flanges 28, so as to lock each pair of frame members 22 together to form a solid corner assembly.

The front plate is preferably recessed behind the front margin 18B of each of the sidewalls 18 in the manner illustrated in FIG. 3. This has several advantages. The front plate 16 is preferably bonded to each of the sidewalls 18 by means of some suitable adhesive, and this inevitably introduces some small bubbles into the interfaces between the front plate 16 and each of the sidewalls 18. By recessing the front plate 16 in the manner indicated, as opposed to placing it over the front margins 18B, one assures that the interface area 48 faces sidewardly rather than forwardly, and thus is not as readily visible to those who are viewing the artwork 10, who would normally be expected to stand more or less directly in front of the enclosure 12.

In addition, this preferred method of recessing the front plate 16 assures that the front plate 16 rests upon the lowermost sidewall 18, a feature which better supports the weight of the front plate, and does not depend entirely upon the strength of the adhesive.

An additional expedient which helps to make the bubbles at the interface area 48 less visible is to cut and polish a beveled surface 18C near the front margin of each of the sidewalls 18. The refraction of light caused by this beveled surface 18C has the effect of making the air bubbles in interface region 48 much less noticeable.

In mounting the sculpture 10 upon the smooth surface of the backing board 20, several problems are encountered. First of all, the large scale unevenness of the rear surface 10B (see FIG. 5) of the paper sculpture does not permit it to make contact with the flat surface of the backing board 20 at more than a few locations. If the sculpture were pressed into close adherence with the backing board 20 at a greater number of locations, the sculpture would be deformed, and its artistic qualities altered.

Secondly, the small scale roughness of the rear surface 10B of the sculpture is such that it would not make intimate contact with the flat surface of the backing board 20 even at those locations where the two do meet. Thus it would be difficult to bond the sculpture 10 securely to the backing board 20. And in any event it would be undesirable to bond these two directly, since subsequent removal of the sculpture 10 from the backing board 20 would no doubt result in the tearing out of pieces of the *papier mache* material from the sculpture, thus damaging and weakening it.

The present invention solves these problems by using a number of spacers 50, preferably in the form of rigid plastic spacer blocks of varying thickness, to accomodate the uneven rear surface 10B of the artwork. Thus, as seen in FIG. 6, the thickness of one of the blocks can be a dimension X to accommodate one portion of the artwork which is relatively close to the backing board 20, another spacer block 50 having a greater thickness Y can be used at another location where the rear surface 10B is somewhat further away from the backing board 20, and again at a third location a spacer block having a thickness dimension Z can be used to accommodate yet another area of surface 10B which is again somewhat closer to the backing board 20.

These spacer blocks 50, as best seen in FIG. 3, are secured to the backing board 20 by means of bolts 52 which thread into sheet metal nuts 54. The sheet metal nuts are of a conventional type, formed with sharp prongs 56 designed to bite into the rear surface of the backing board 20.

In order to avoid the need for directly bonding the paper sculpture 10 either to the backing board 20 or to the spacer blocks 50, the present invention makes use of textile fastener pads 58 (see FIGS. 3 and 4) of the type which are readily available under the brand name Velcro. These textile pads come in pairs, one pad of each pair having resilient fiber hooks, and the other pad of each pair having resilient fiber loops, the hooks and loops interengaging with each other upon contact to form a connection which is strong but removable and re-engagable. One textile fastener pad of each cooperating pair is bonded by means of any suitable adhesive, for example, a silicone material, to the rear surface 10B of the paper sculpture. The other cooperating textile fastener pad is bonded to the confronting surface of one of the spacers 50. For greater safety, the textile fastener pad 58 which is secured to the spacer 50 is provided with small flat-headed wood screws 60 which thread all the way through the spacers 50 and part way into the backing board 20. In addition, the bolts 52 also pass through this particular textile fastener pad 58. The bolt 52 and wood screws 60, however, all have relatively flat heads so as not to interfere with mating engagement between the cooperating pairs of textile fastener pads 58.

After the textile fastener pads are suitably mounted at the appropriate locations upon the rear surface 10B of the paper sculpture, and the front surfaces of the respective spacers 50 confronting those locations, the paper sculpture can be reliably secured to the spacers, and thus to the backing board 20, yet can thereafter be readily removed by simply disengaging the cooperating pairs of textile fiber pads 58, without any risk of tearing or otherwise damaging the paper sculpture 10.

It will now be appreciated that the enclosure and mounting device of this invention permits mounting of an artwork of this kind in a way that accommodates the large scale unevenness of the rear surface, permits reliable mounting of the artwork without risk of damage upon its removal, and encloses the artwork in a container which protects it from mechanical contact and also from atmospheric contaminants.

The described embodiments represent the preferred form of the invention, but alternative embodiments may be imagined which would come within the novel teachings herein. Accordingly, these embodiments are to be considered as merely illustrative, and not as limiting the scope of the following claims.

The invention claimed is:

1. An enclosure comprising:

a shell having a transparent front plate and sidewalls extending rearwardly from said front plate and partially enclosing an open space at the the rear of said front plate to accommodate a display object therewithin;

re-entrant means on said side walls;

frame means each having front flange means received within said re-entrant means and rear flange means spaced rearwardly from the rearmost surfaces of said sidewalls;

backing means separate from said frame means, extending across said entire open space to complete the enclosure thereof, and received between said sidewalls and said rearmost surfaces of said rear flange means;

and means reacting against said rear flange means to press said backing means against said rearmost surfaces of said sidewalls.

2. An enclosure as in claim 1:

wherein said reacting means comprise resilient leaf spring means compressed between said rear flange means and said backing means;

and further comprising adhesive material lodged between said rear flanges means and said backing means to help retain said leaf spring means in place.

3. An enclosure as in claim 1 in combination with:

a display object within said open space;

and at least one pair of releasably interengaging textile fastener means, one of which is mounted upon a front surface of said backing means, and the other of which is mounted upon a rear surface of said display object, for removably securing said display object to said backing means within said open space.

* * * * *